US005217752A

United States Patent [19]

Perez

[11] Patent Number: 5,217,752

[45] Date of Patent: Jun. 8, 1993

[54] F.P. SYSTEM FOR MANUAL RESTORATION

[76] Inventor: Freddy A. Perez, 130 Wadsworth Ave., Apt. 24, New York, N.Y. 10033

[21] Appl. No.: 595,620

[22] Filed: Oct. 11, 1990

[51] Int. Cl.[5] ..... B32B 35/00

[52] U.S. Cl. ..... 427/140; 156/94; 427/296

[58] Field of Search ..... 427/140; 156/94

[56] References Cited

U.S. PATENT DOCUMENTS

| | | | |
|---|---|---|---|
| 3,096,194 | 7/1963 | Klimann | 427/140 |
| 3,265,515 | 8/1966 | Wihelmson | 427/140 |
| 3,698,925 | 10/1972 | Salz et al. | 427/140 |
| 4,234,621 | 11/1980 | Fieux | 427/140 |
| 4,305,773 | 12/1981 | Hendricks | 427/140 |
| 4,602,971 | 9/1986 | Bergeron et al. | 156/94 |
| 4,724,158 | 2/1988 | Mollett et al. | 427/140 |
| 4,860,685 | 8/1989 | Smith | 427/140 |
| 4,917,745 | 4/1990 | Speer | 427/140 |

FOREIGN PATENT DOCUMENTS

| | | | |
|---|---|---|---|
| 53-043658 | 11/1978 | Japan | 156/94 |

OTHER PUBLICATIONS

"Paper Conservation Leafcaster"-Advertising Copy.

Alkalay, Stella Ester, (Untitled) *Restaurator*, vol. 11 No. 2 (English Translation).

*Primary Examiner*—Janyce Bell

*Attorney, Agent, or Firm*—Abdallah & Muckelroy

[57] ABSTRACT

A restoration method and apparatus whereby a paper fiber dispenser with a vibrating motor causes paper fibers in a dry state to fall onto a disposable filter and within missing part or parts of paper being restored thereon. Paper fibers are collected and immobilized on disposable filter and within missing part or parts of paper being restored as underside of disposable filter is subjected to suction. Water-base adhesive is applied with brush to paper fibers. Paper fibers are compacted with spatula. A tensional filter counteracts pressure exerted with spatula on paper fibers. A tensional filter and disposable filter are subjected to humidity to prevent glue residue from solidifying on tensional filter and to facilitate peeling off disposable filter from restored paper. A restoration table is equipped with a tensional filter and a vacuum and humidification chamber in communication with a source of suction and a source of humidity. Suction and humidification control means are in communication with said suction and humidification sources.

1 Claim, 15 Drawing Sheets

F.P. SYSTEM FOR MANUAL RESTORATION

BACKGROUND—FIELD OF INVENTION

This invention relates to an apparatus for and a method of restoring works on paper and the like; and more particularly to an apparatus and method for reconstructing lost areas of a work on paper and the like with varying amounts and kinds of suitable paper fibers and glue, while, and by subjecting the work on paper and the paper fibers to the influence of suction, and by subjecting residual glue to the influence of humidification.

BACKGROUND—DESCRIPTION OF PRIOR RESTORATION METHODS

Currently, the two most widely used methods to restore paper are manual restoration, and continuous process restoration.

The method of manual restoration consists of selecting a piece of paper with the same quality, width and texture as the piece to be restored. Next, it is necessary to repair the damaged area, especially the edges of incisions, folds, etc. With a small brush, proper cementing material is applied to the edges of these areas. Then, the direction or "grain" of the fibers in the original paper and that of the replacement paper is determined. Making sure both "grains" coincide, the replacement paper is pasted onto the area to be restored. It is important to remember that the replacement paper must be slightly larger than the original piece so that it may be made to fit more precisely the area being repaired. A surgical knife is used to trim off the excess edges.

The next step is to press the replacing piece of paper with a wooden or metal spatula, particularly in those areas where cement is applied. A thermostatic spatula is often used to accelerate the binding of the old and new papers.

To ensure that the replacing piece remains attached permanently, a special procedure called local lamination is often used in the repair process. Local lamination consists of binding an additional piece of thin, translucent tissue paper, to the original.

The complexity of the manual restoration method makes it easy to understand how stressing the process becomes when a restoration involves the repair of multiple types of damage, including perforations, tears, cracks and fissures.

The continuous process restoration is characterized by the immersion of the work in water in order to disperse the pulp or fibers of the paper to be restored. A typical application of continuous process restoration is restoring areas missing from a document. Equipment available for continuous process applications includes:

a. The "Vinyector" DOCUMENT RESTORATION MACHINE, created by Vincente Vinas Torner, Madrid, Spain.

b. E. Socha Czewer L.T.D.'s MACHINE (Hebrew University of Jerusalem).

c. MS 90210-88 Paper Conservation Leaf CASTER, from Maryland, USA.

d. The "Delma" MACHINE, created by Ignacio Delfing, Mexico.

In general terms, while these processes are often employed in the restoration of printed material, further problems may be created due to the solubility of the visual or aesthetic characteristics of some works on paper. Such works cannot be exposed to the humidification used in continuous process methods of restoration unless their tints or pigments are sprayed with fixatives. The use of fixing solutions, however, may create other problems because their acidity may leave yellow stains on the paper. The use of aerosol fixatives, on the other hand, poses further problems in that their use is discouraged because of potential damage to the earth's ozone layer.

SUMMARY OF THE INVENTION

The present invention discloses a novel apparatus and method for manual restoration of a work on paper or like materials which includes means to filter and disperse dry fibers in a small space. In a further embodiment of the invention the damaged area of a work to be restored is subjected to humidification and vacuum suction.

The apparatus of the present invention generally comprises a mobile dry fiber dispenser, a restoration table for receipt of the work to be restored, and a humidification-suction system communicating with the work.

The method of the present invention generally comprises placing the work to be restored face down on the restoration table, mechanically shredding the fibers of a dry restoration material, filtering the shredded fibers, depositing the shredded and filtered fibers on the damaged area of the work, partially applying chemical binding means to the fibers, and compacting the files in the damaged area of the work, all of these steps being conducted with the work subjected to vacuum suction.

Objects and Advantages

Use of my new method and apparatus for restoration of works on paper offers the following objects and advantages:

1. It is an object of my invention to restore works on paper without the tedious, inefficient, and monotonous processes employed in other restoration methods.

2. It is a further object of my invention to eliminate the risk of dissolving inks, pigments, or any other element which are a part of the aesthetic or visual manifestation of the work on paper under treatment; this is possible because there is no need to humidify any part of the work.

3. It is a further object of my invention to facilitate reconstruction of very small, perforated or cracked areas by using paper fibers subjected to suction to fill said small perforations and cracked areas.

4. It is a further object of my invention to provide the means for capturing, confining, and immobilizing paper fibers through the use of suction.

5. It is a further object of my invention to quickly cure aided by use of a spatula and suction, paper fibers mixed with a water-base glue.

6. It is a further object of my invention to provide a means whereby a plurality of areas needing repair can be treated simultaneously.

7. It is a further object of my invention to immobilize and straighten paper under treatment by use of suction.

8. It is a further object of my invention to eliminate the procedure of superimposing a patch over the missing part of the work under treatment, adjusting the patch to the defective area, and trimming off with a surgical knife the excess edges.

9. It is a further object of my invention to apply humidification to filters beneath the work being repaired in order to prevent hardening of the residual water-base glue and to prevent clogging of the filters.

10. It is a further object of my invention to remove, by means of suction, any residual water-base glue from the filters.

11. It is a further object of my invention to evacuate excessive humidity and condensed water from a vacuum chamber by means of suction.

12. It is a further object of my invention to provide a time-saving, practical, and inexpensive means of performing high quality restorations on paper-based work that is easy to use and relatively inexpensive to manufacture.

Further objects and advantages are to provide these additional improvements in the reconstruction process, and which do not occur with use of the other methods or systems:

1. Stains may be removed.
2. Creases may be removed, and surfaces strengthened.
3. Imitation with replacement material of the original texture of the document being restored.
4. Surfaces of works are strengthened through the reconstruction process.
5. It does not require the use of fixatives on soluble tints even when aerosol sprays are used.
6. It is not necessary to spray the work with water, nor does it need water for dispersion of cellulose or to remove paper fibers. Such treatments involve a risk of dissolving inks, pigments, and other elements which are part of its aesthetic or visual manifestation.
7. It is not necessary to apply steam to any part of the object being restored, and which application involves the same risks as immersion treatments.
8. It is not necessary to know the exact concentration of fiber in the pulp in order to attain the desired thickness in the area being restored.
9. It is not necessary to use blotting paper, to apply pressure to the damaged area.
10. The use of surgical knives is limited to preliminary preparation of area being restored.
11. My new method and apparatus for paper restoration enable restoration work on paper to be accomplished with ease, regardless of type of paper or alteration needed; this work may take place without fear of causing chemical or physical damage. This work may also take place on materials with insoluble tints. These and other objects and features of my invention will be best understood and appreciated from the following description of the preferred embodiment thereof, selected for purposes of illustration, and shown in the accompanying drawings.

DESCRIPTION OF PREFERRED EMBODIMENT

Figure 6:
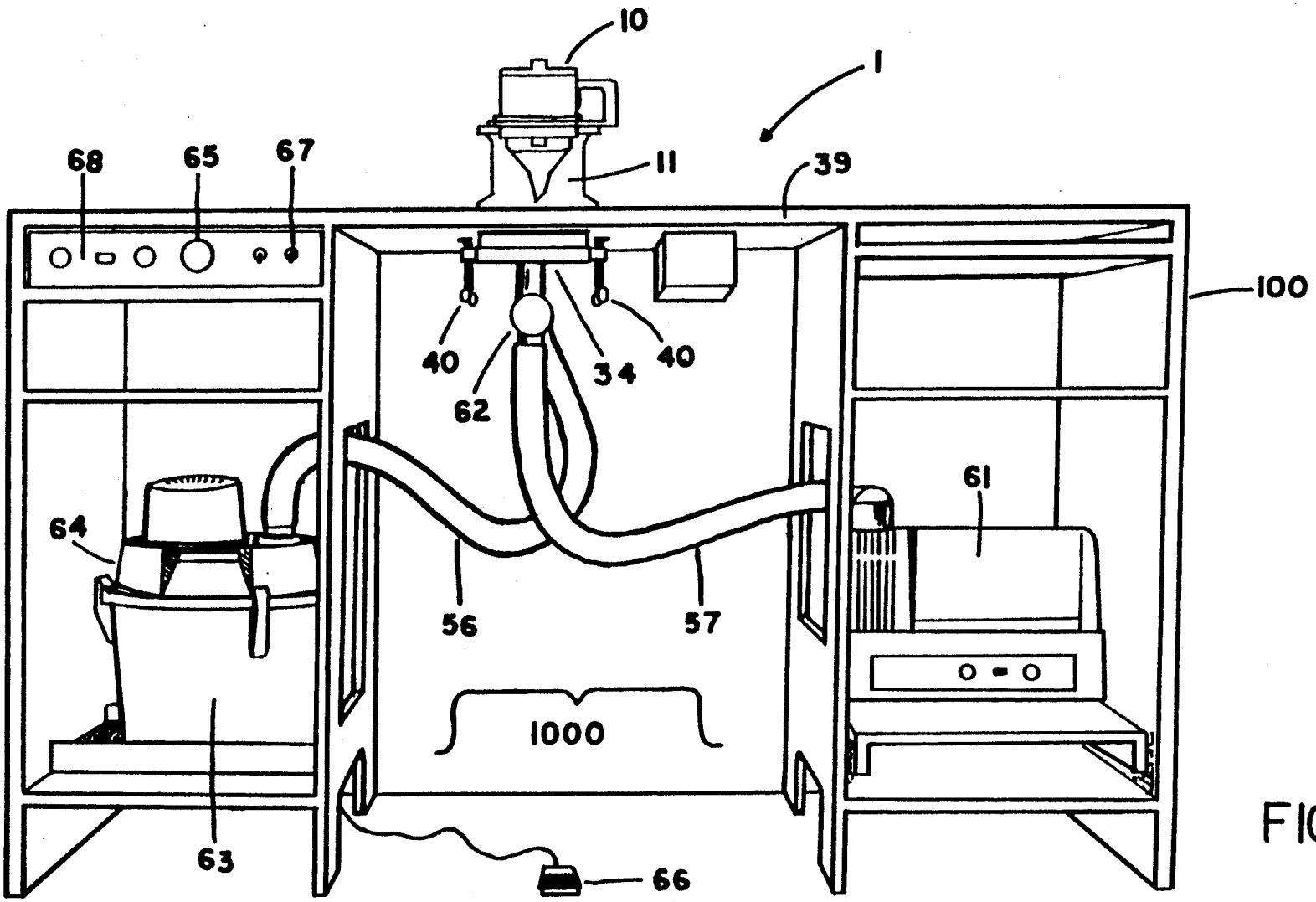
FIG. 6 is a perspective view showing the paper fiber dispenser on top of a preferred work table incorporating the vacuum chamber, the vacuum machine, the humidifier, hoses, control panel, and pedal switch.

The apparatus 1 for manual restoration of a work on paper or like materials disclosed in the present invention is best seen in FIG. 6. Apparatus 1 generally comprises a paper fiber dispenser 10, a restoration table 100, and a humidification-suction system 1000.

Paper fiber dispenser 10 is shown in greater detail in FIGS. 1A–1E.

| Reference Numerals in Drawings | |
|---|---|
| 10 | paper fiber dispenser |
| 11 | receptacle |
| 12 | encapsuled motor |
| 13 | bolt |
| 14 | threaded end |
| 15 | false funnel |
| 16 | toothed ring |
| 17 | filter |
| 18 | paper fiber compartment |
| 19 | connecting member |
| 20 | exterior wall |
| 21 | secondary funnel |
| 22 | handle |
| 23 | on-off switch |
| 24 | battery compartment |
| 25 | battery |
| 26 | removable lid |
| 27 | sliding lid |
| 28 | dispenser base |
| 29 | paper being restored |
| 30 | disposable filter |
| 31 | rectangular opening |
| 32 | table platform |
| 33 | tensional filter |
| 34 | vacuum and humidification chamber |
| 35 | paper fibers |
| 36 | missing part of paper |
| 37 | metal frame |
| 38 | screen |

-continued

| Reference Numerals in Drawings | |
|---|---|
| 39 | table platform surface |
| 40 | thumb screws |
| 41 | vacuum chamber base |
| 42 | brackets |
| 43 | lateral rail |
| 44 | peripheral frame underside |
| 45 | peripheral frame |
| 46 | inner frame |
| 47 | screws |
| 48 | rabbet cut |
| 49 | rabbet cut |
| 50 | rectangular box |
| 51 | final filter |
| 52 | beehive filter |
| 53 | columnar filter |
| 54 | solitary filter |
| 55 | vacuum chamber bottom |
| 56 | vacuum chamber hose |
| 57 | humidifier hose |
| 58 | vacuum hose opening |
| 59 | humidifier hose opening |
| 60 | ring |
| 61 | humidifier |
| 62 | valve |
| 63 | vacuum water tank |
| 64 | vacuum machine |
| 65 | speed adjusting knob |
| 66 | pedal switch |
| 67 | manual switch |
| 68 | control panel |
| 100 | restoration table |
| 1000 | humidification - suction system |

Centered on said paper fiber dispenser 10, I include a receptacle 11 housing an encapsuled motor 12, with its upper end attached to the top of said receptacle 11, by means of a single bolt 13. Attached to the threaded lower end 14 of the encapsulated motor 12 is a frustum-shaped "false funnel" 15 housing a toothed ring 16 and a filter 17. Said toothed ring 16 and filter 17 form the bottom of the paper fiber compartment 18. The receptacle 11 of the encapsuled motor 12 is kept in place by three connecting members 19 (one shown), that extend radially to the exterior wall 20 of the paper fiber dispenser 10.

Figure 1B:
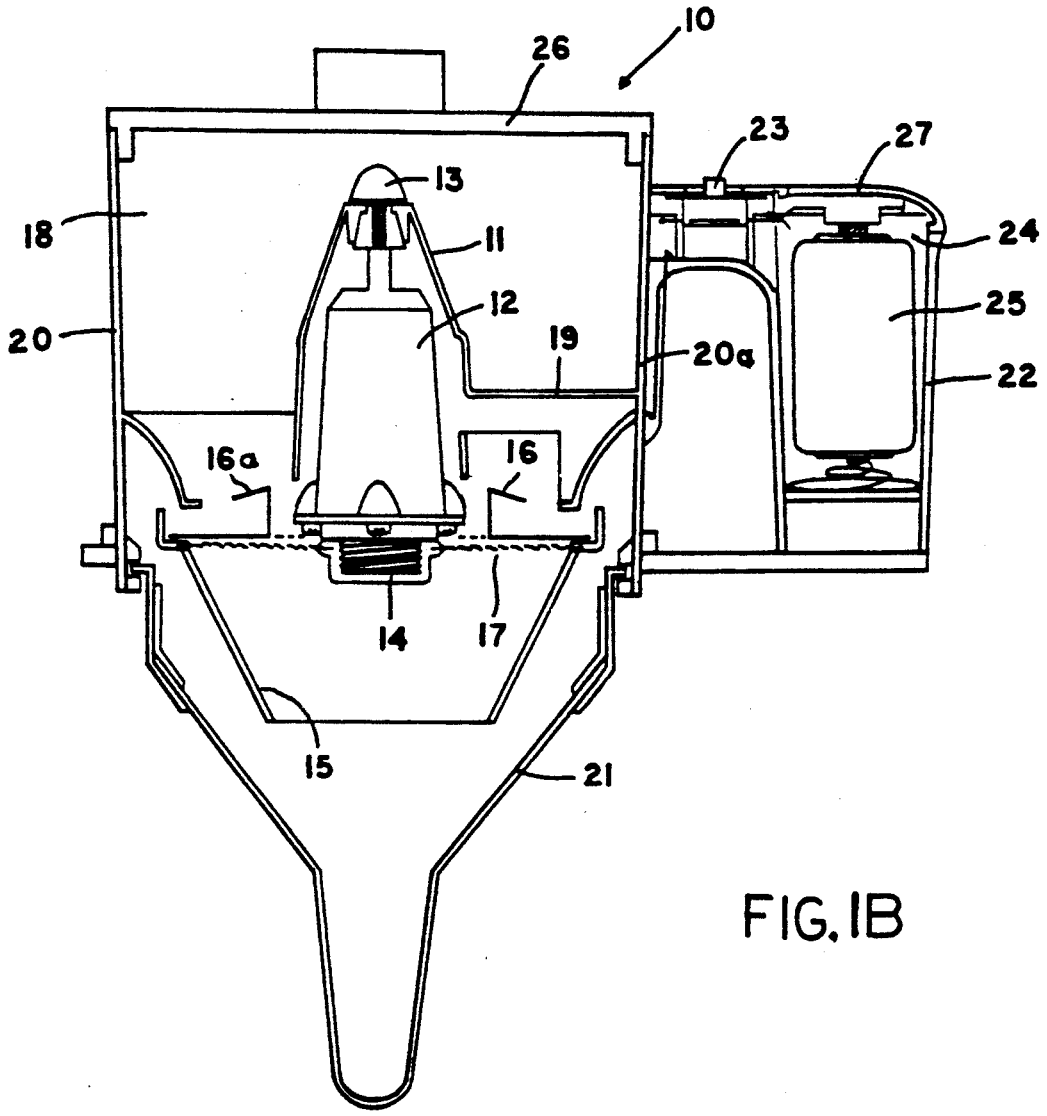
FIG. 1B is a cross-sectional view taken along line A—A of FIG. 1A showing further details of the paper fiber dispenser.
Figure 1A:
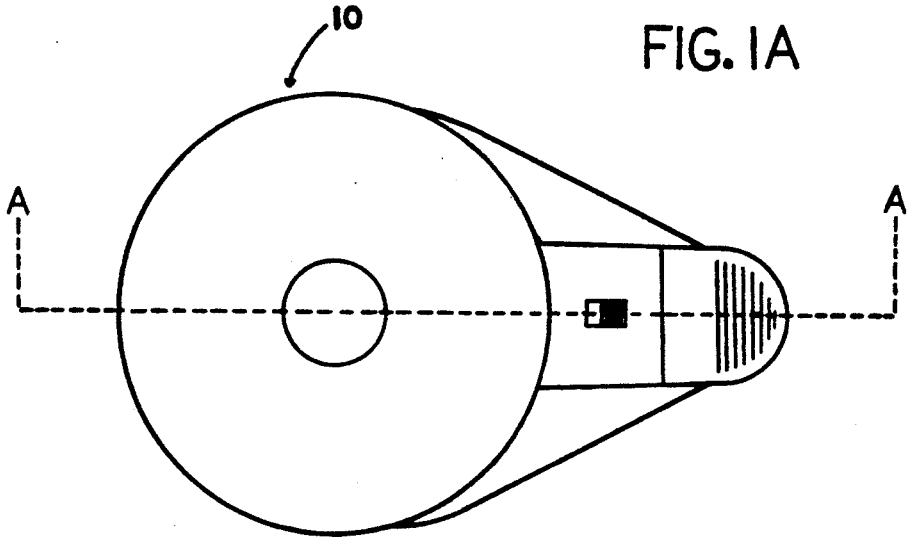
FIG. 1A is a top view of the paper fiber dispenser.
Figure 1D:
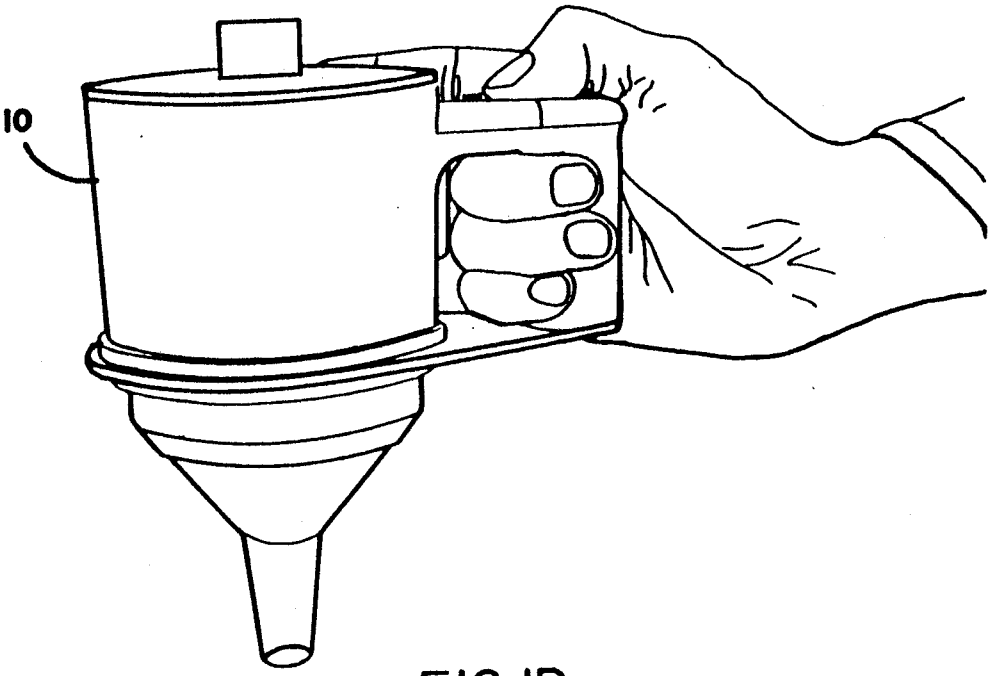
FIG. 1D is a perspective view showing the paper fiber dispenser away from its base.
Figure 1C:
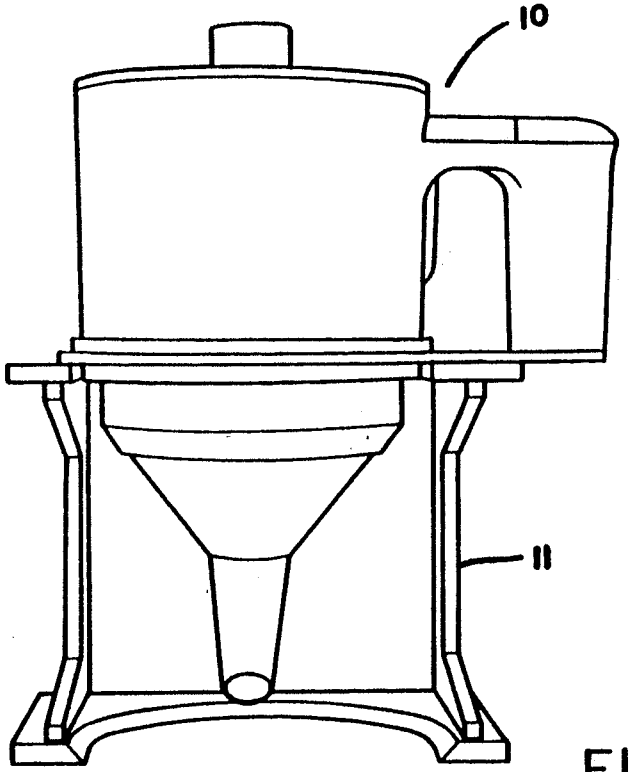
FIG. 1C is an elevational view showing the paper fiber dispenser on its base.
Figure 1E:
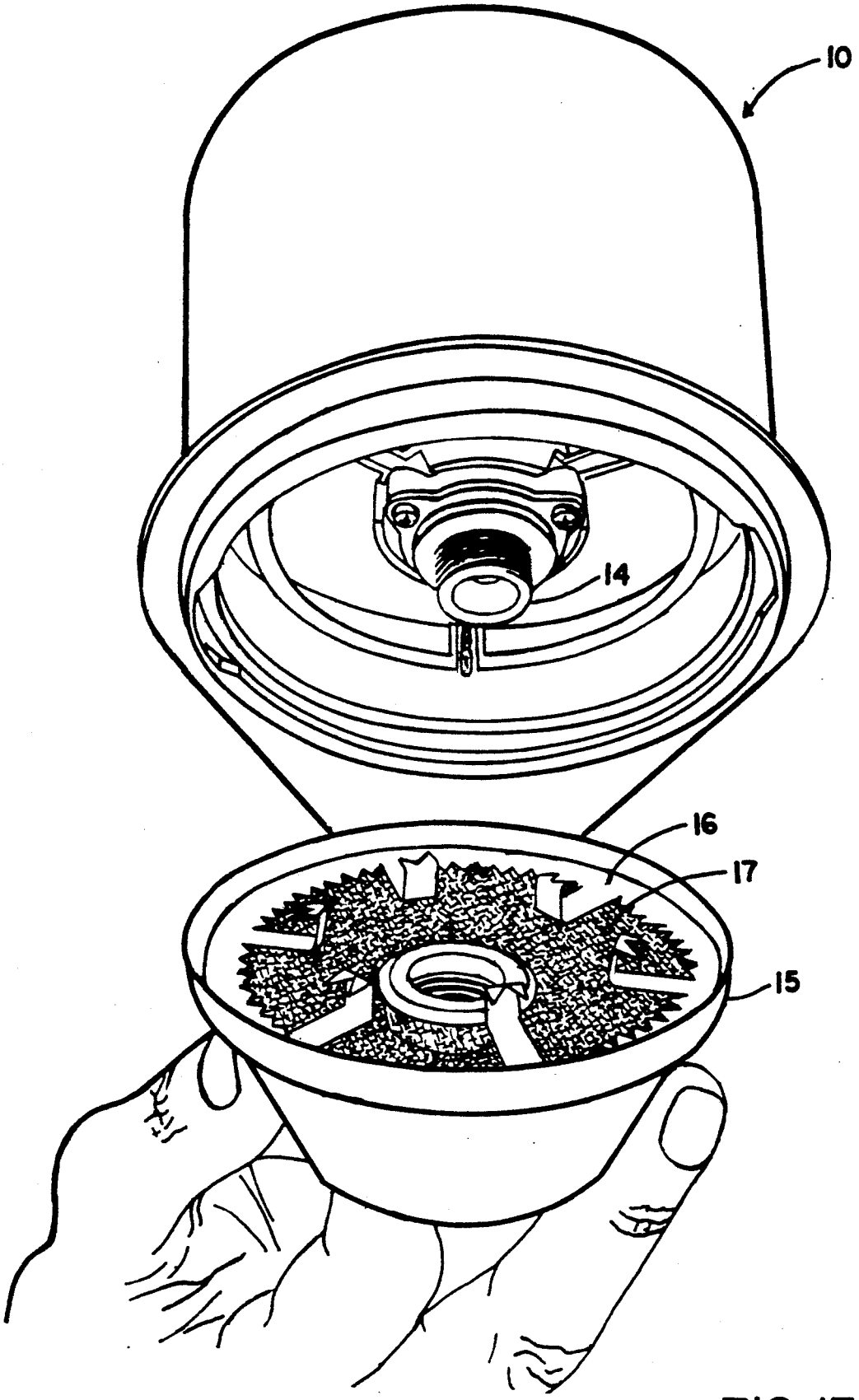
FIG. 1E is a perspective view showing the false funnel, the toothed ring, and the threaded end of paper fiber dispenser motor.
Figure 2:
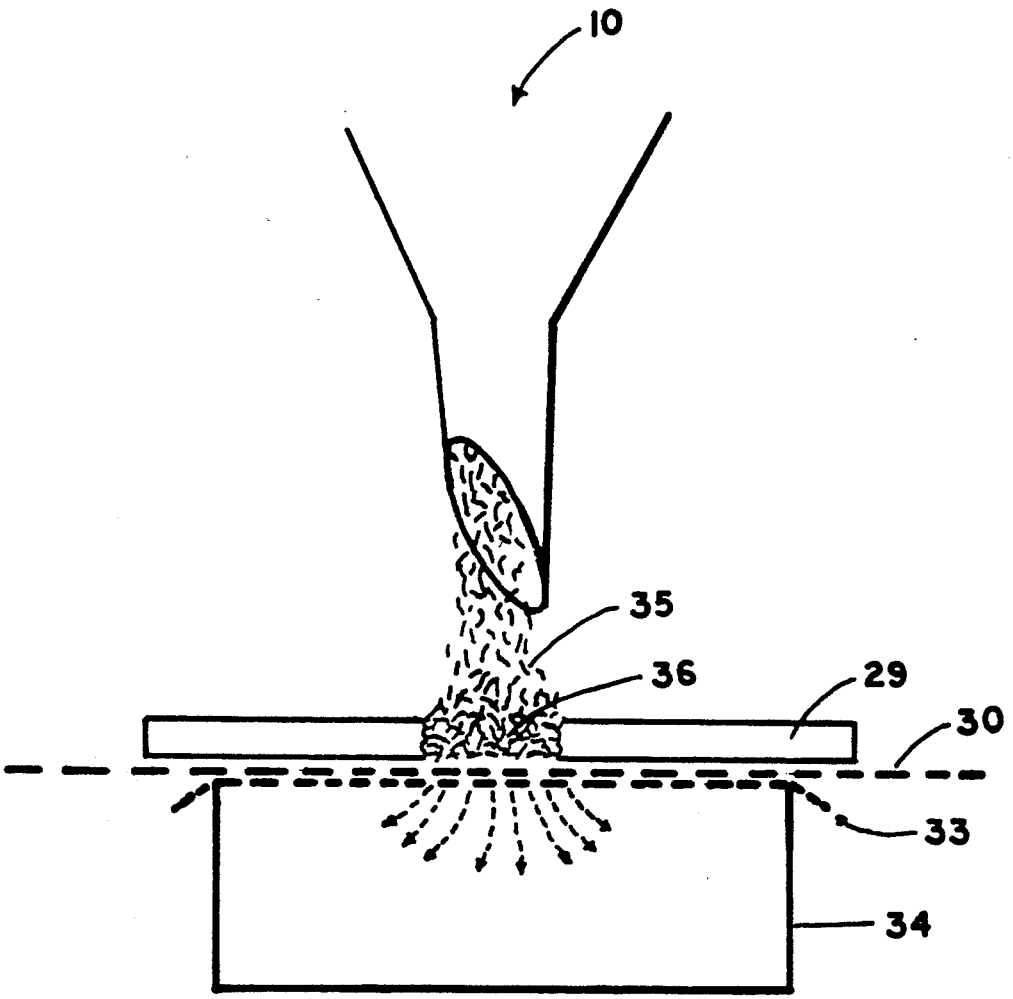
FIG. 2 is a front view showing paper fibers deposited in the missing part of paper being restored and the disposable filter thereunder.
Figure 3:
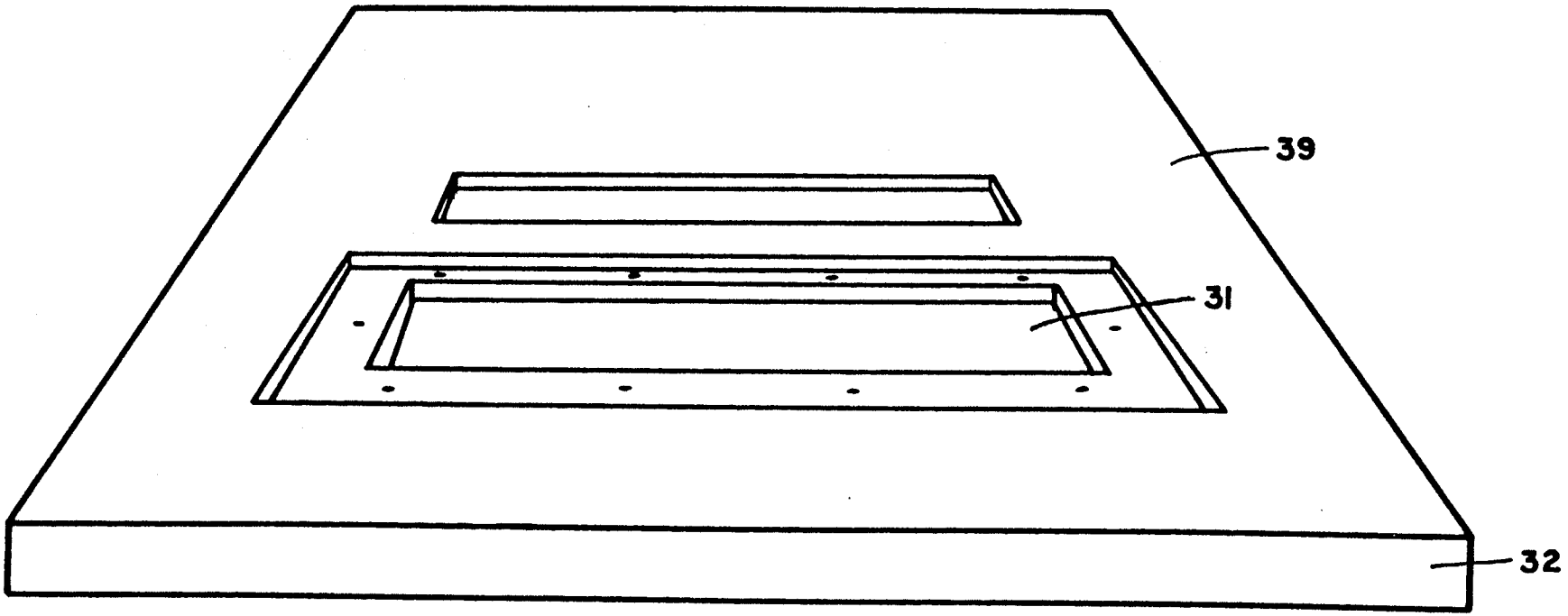
FIG. 3 is a perspective view of table platform showing rectangular openings where vacuum chamber and tensional filter are placed in table platform.
Figure 4A:
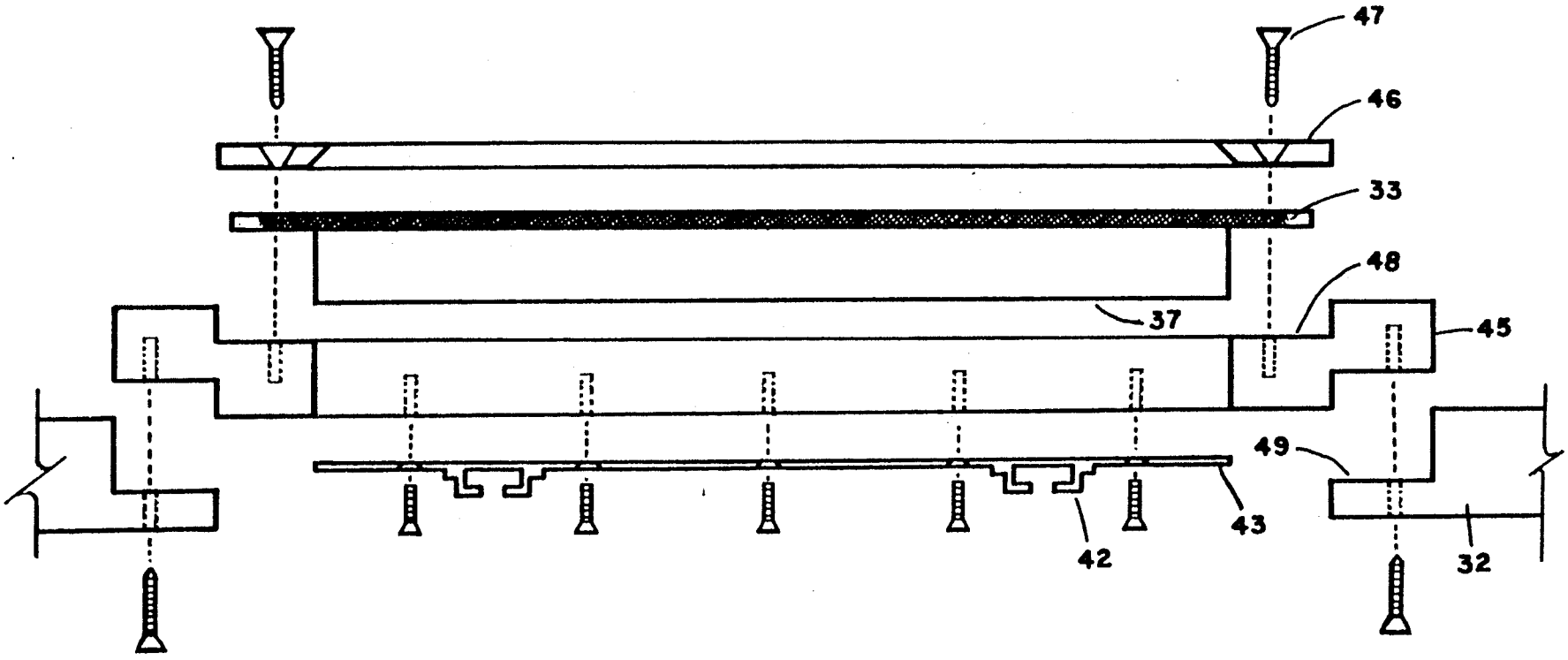
FIG. 4A is an exploded elevational view showing the inner-frame and tensional filter inlaid in peripheral frame.
Figure 4B:
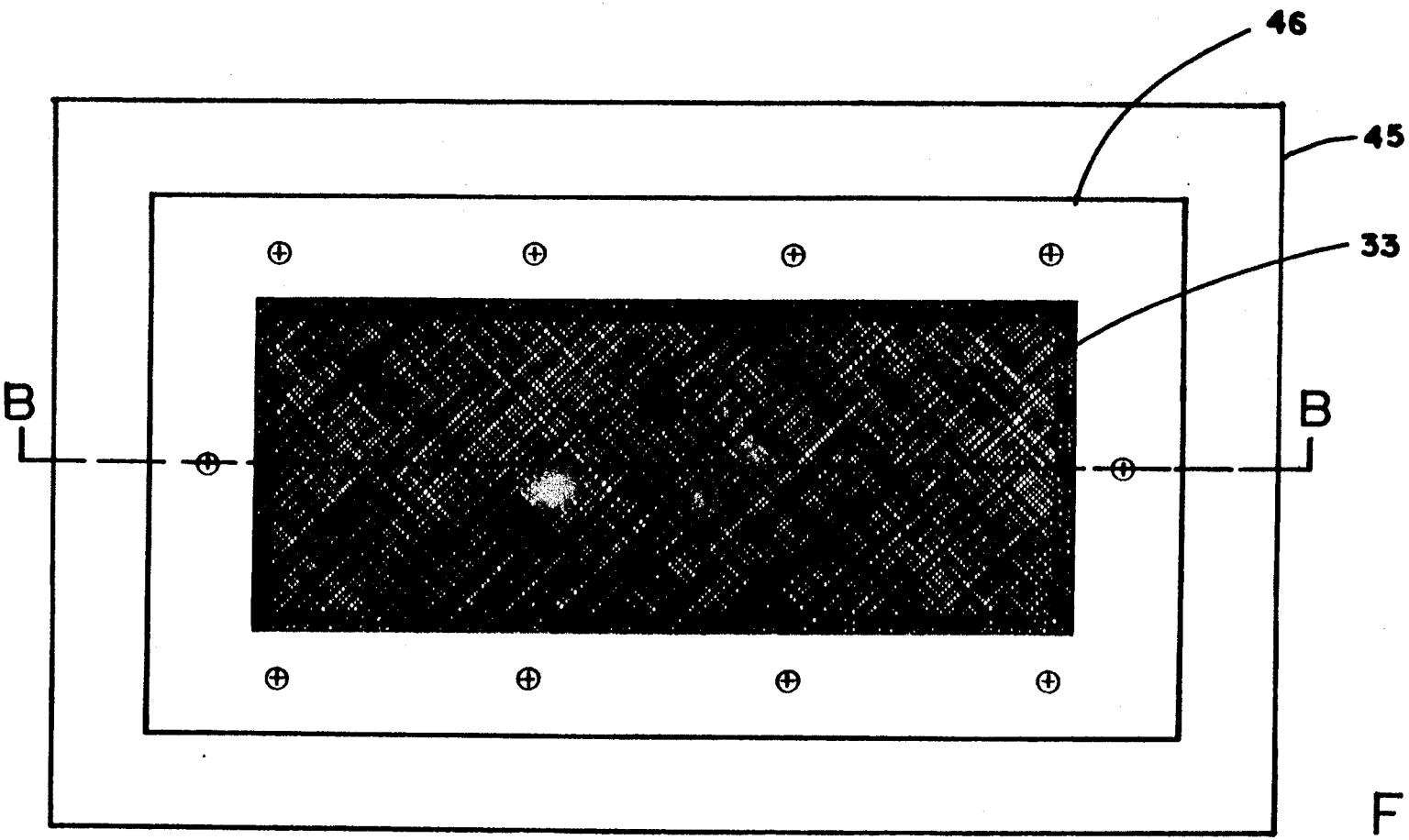
FIG. 4B is a top plan view of the assembly illustrated in FIG. 4A.
Figure 4C:
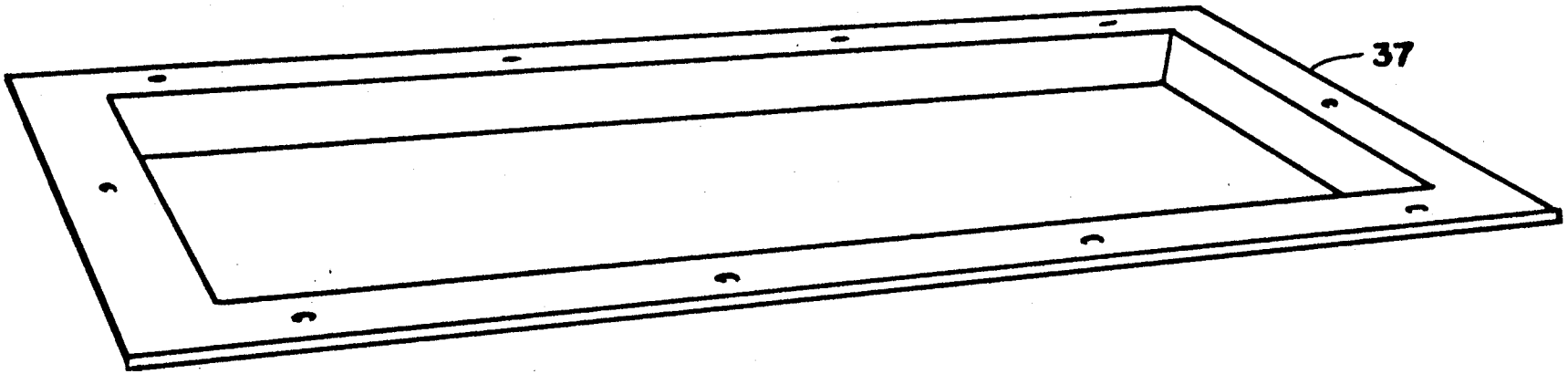
FIG. 4C is a perspective view of the tensional filter metal frame.
Figure 4D:
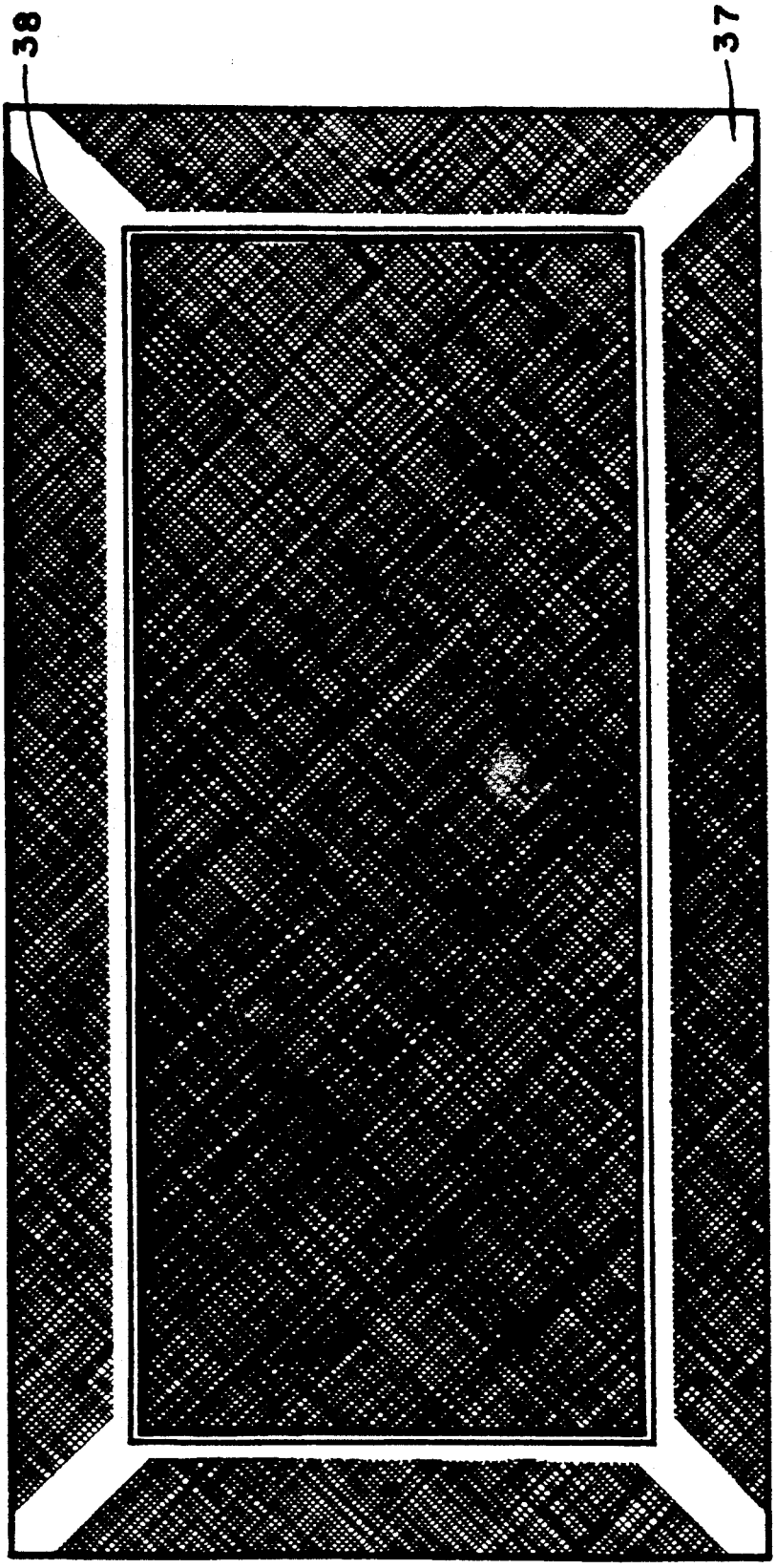
FIG. 4D is a view of the underside of the tensional filter showing the screen margins in folded position.
Figure 5A:
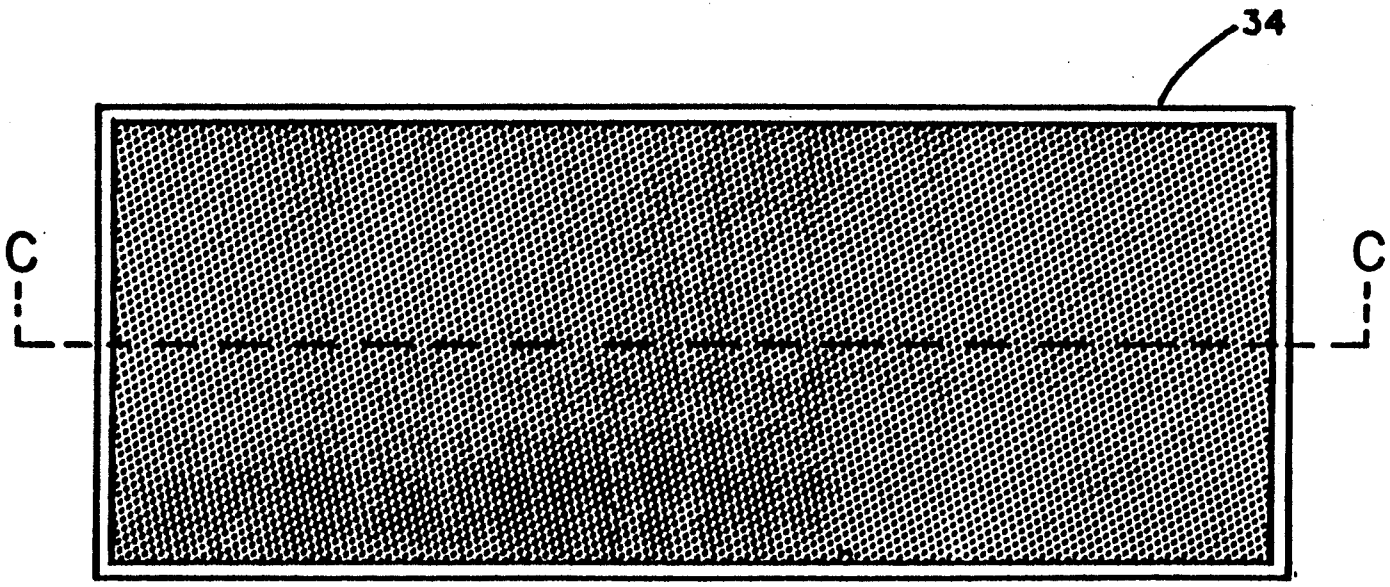
FIG. 5A is a top view of the vacuum and humidification chamber.
Figure 5B:
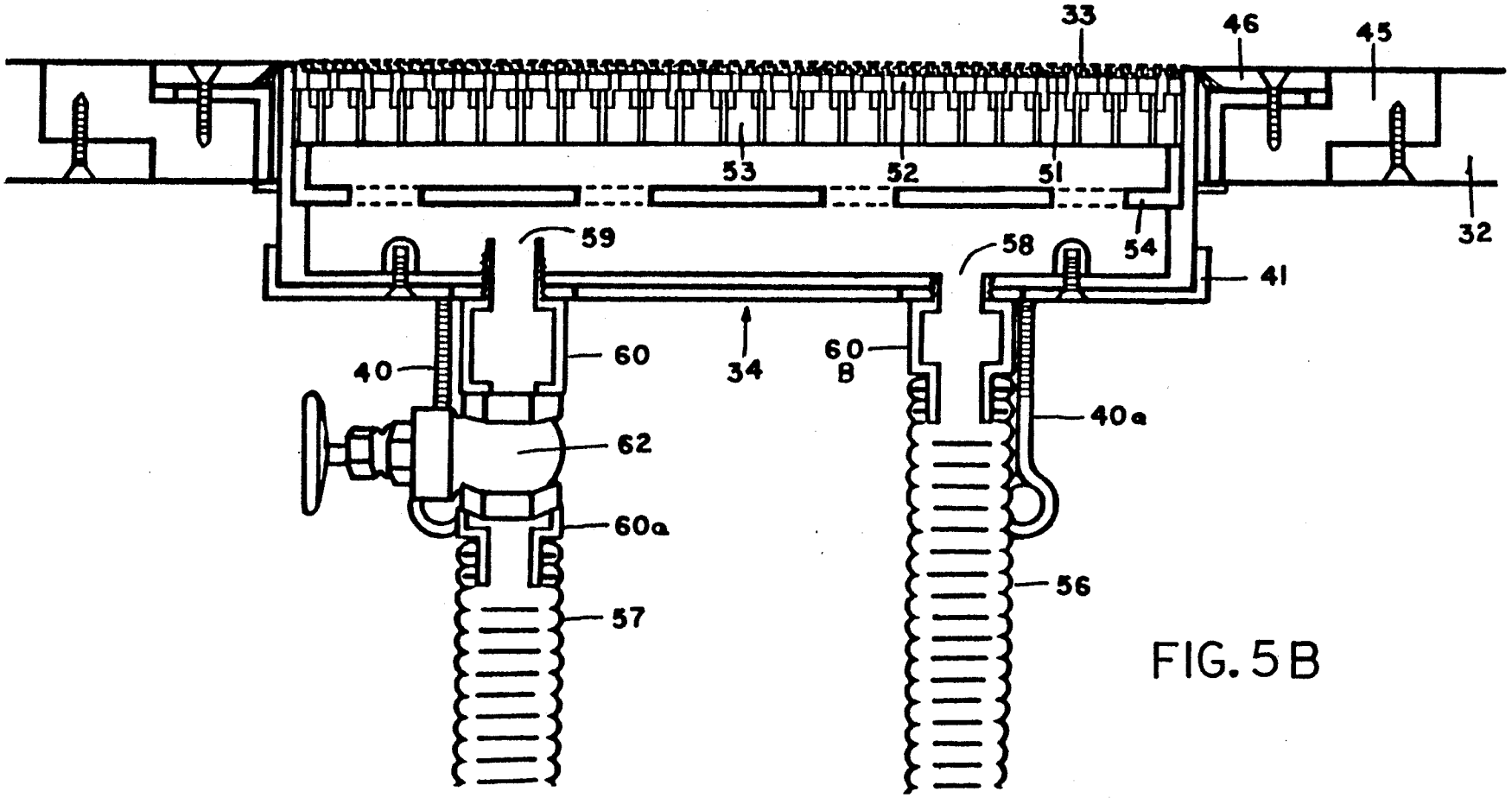
FIG. 5B is a cross-sectional view taken along line C—C of FIG. 5A showing further details of the vacuum chamber in table platform.
Figure 5C:
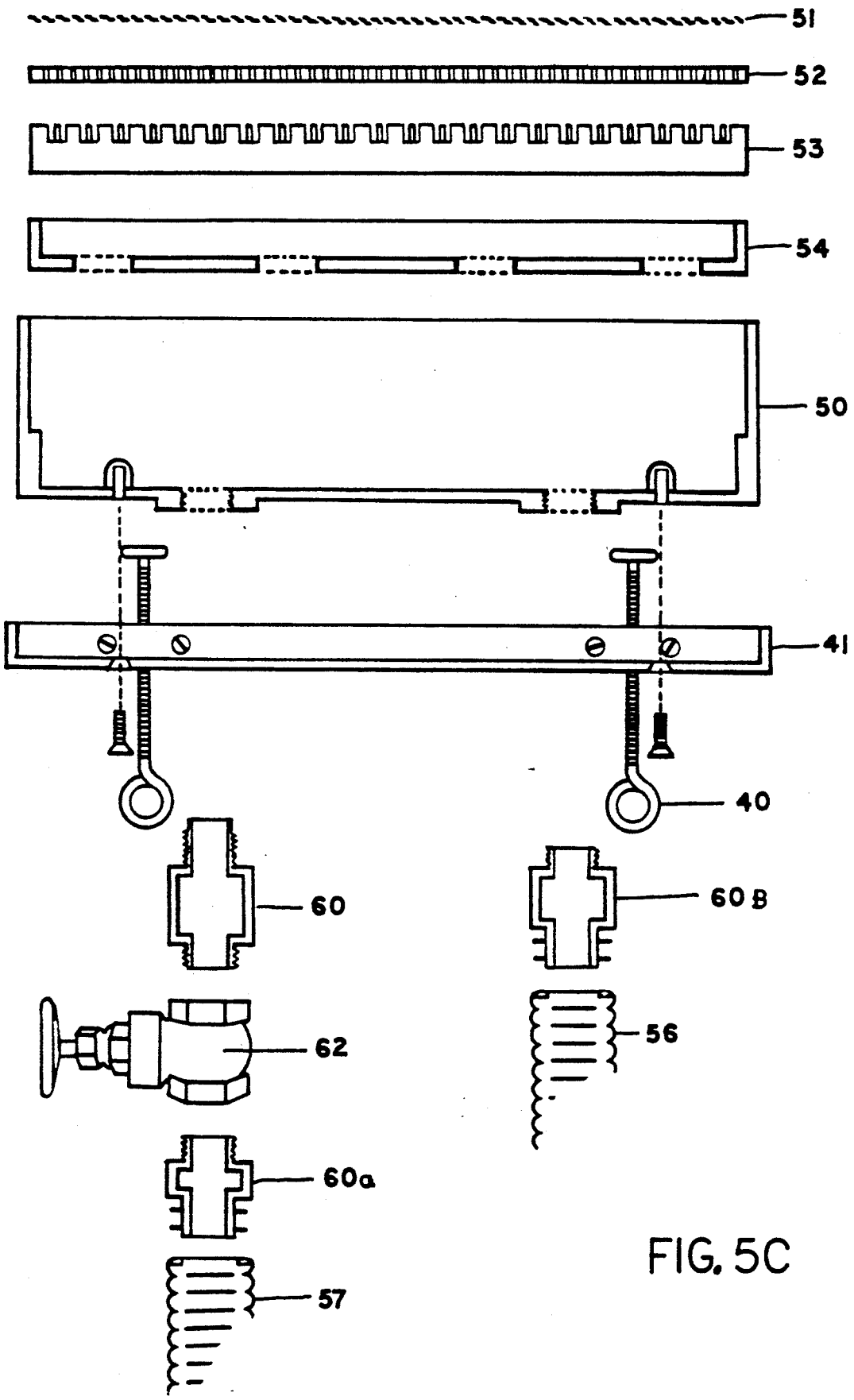
FIG. 5C is an exploded sectional view taken along line C—C of FIG. 5A showing further details of the vacuum chamber before assembly.
Figure 5D:
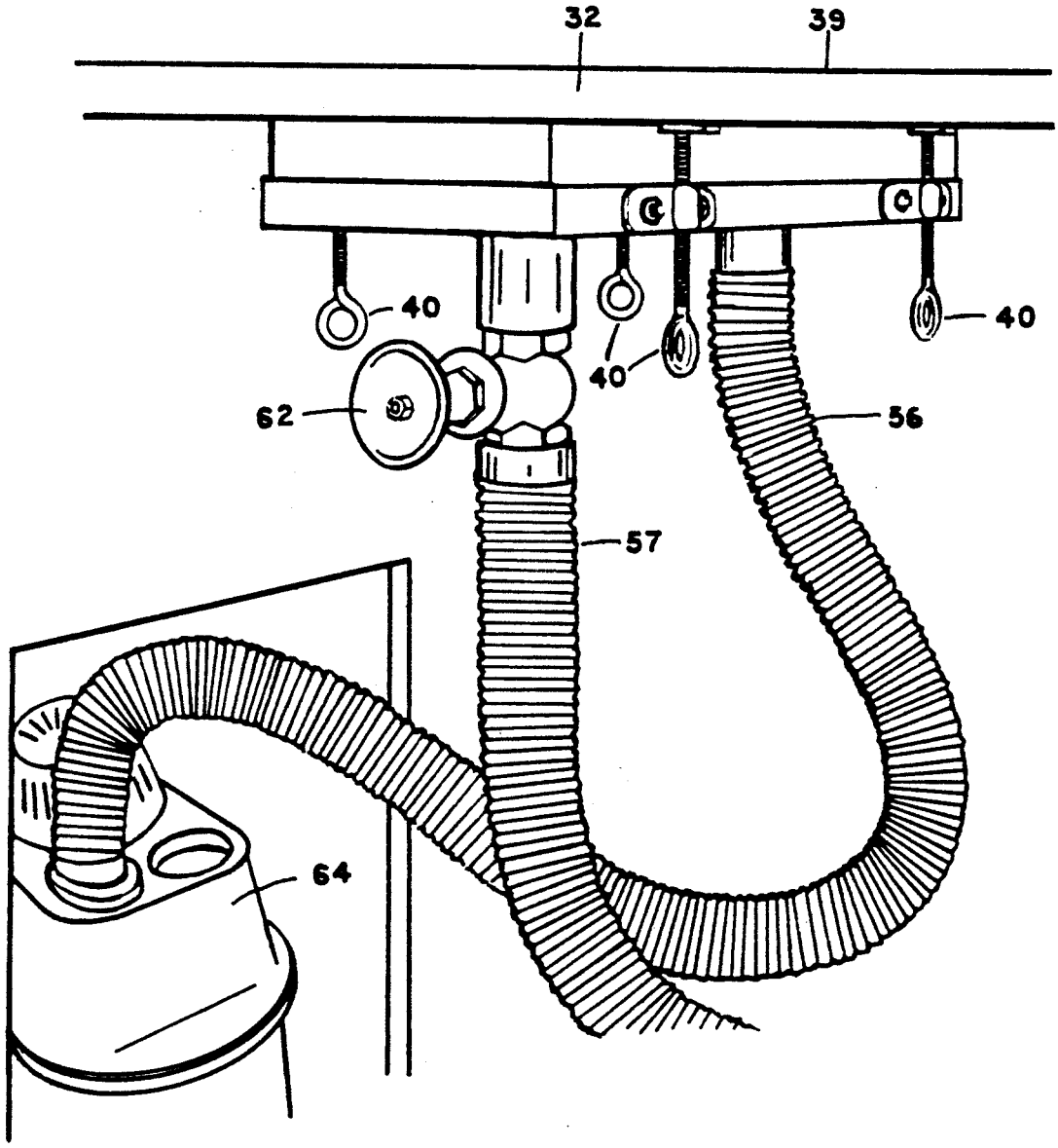
FIG. 5D is a perspective view of the vacuum chamber showing the thumb screws used to raise it.
Figure 5E:
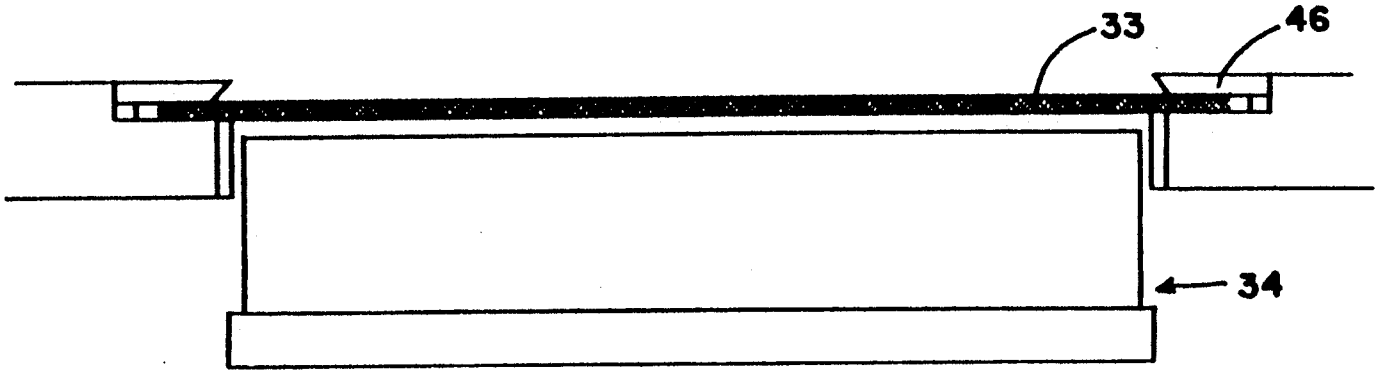
FIGS. 5E, 5F and 5G are side views of the tensional filter as it is raised to surface of table platform by the vacuum chamber.
Figure 5F:
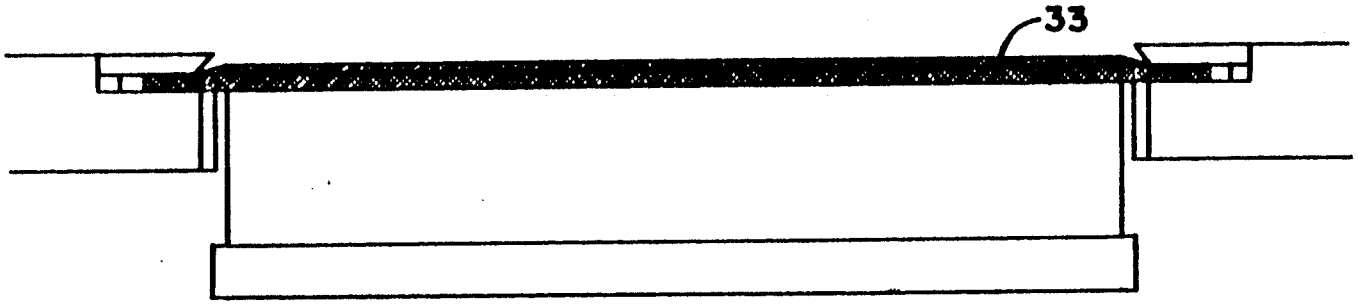
Figure 5G:
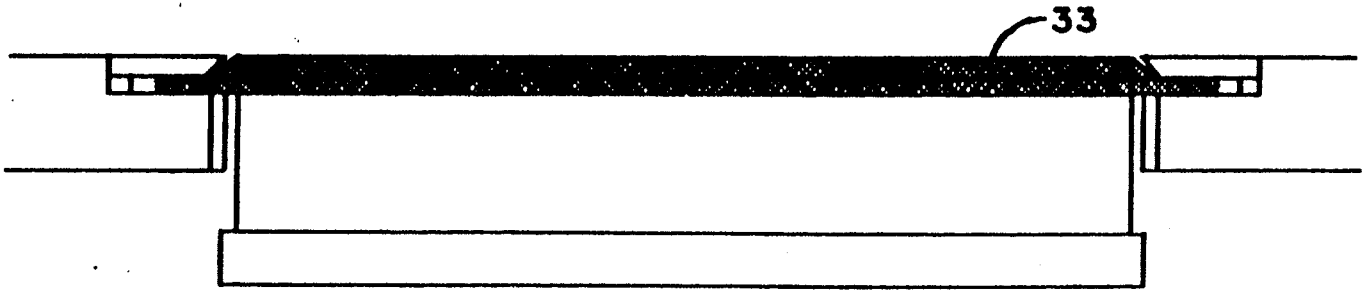

The receptacle 11 for the encapsulated motor 12 is made large enough to allow vibration of the motor 12 attached to the false funnel 15. Immediately below the false funnel 15, I place a secondary funnel 21 which conforms the bottom part of the paper fiber dispenser 10. Attached to the exterior wall 20 of the paper fiber dispenser 10 is a handle 22 with an on-off switch 23, and a built-in battery compartment 24 and a battery 25. A removable lid 26 covers the paper fiber dispenser 10 and a sliding lid 27 covers the battery compartment 24 in the handle 22. The paper fiber dispenser 10 rests on a detachable base 28, allowing the paper fiber dispenser 10 to be used independently, or placed over the area being restored. The paper being restored 29 as shown in FIG. 2 is, in turn, placed over a disposable filter 30 centered above an assembly inlaid into a rectangular opening 31 as shown in FIG. 3 in the table platform 32. Said assembly includes from top to bottom: the tensional filter 33 and the vacuum chamber 34. Said disposable filter 30 retains the paper fibers 35 as they fall from the paper fiber dispenser 10, and are collected by the suction within the missing part 36 of the paper being restored 29. Secondary functions of the disposable filter 30 include protection of the paper being restored 29 against excessive humidity coming from the vacuum chamber 34 and protection of the tensional filter 33 against clogging from glue residue and residual paper fibers).

As shown in FIGS. 4A–4D the tensional filter 33 is a metal frame 34 covered by a thin screen 38 made of steel or nylon. Said filter 33 rests horizontally about one-quarter of an inch below the surface 39 as shown in FIG. 3 of the table platform 32. Said screen 38 is raised to the top surface 39 of the restoration table platform 32 by the upward movement of the vacuum chamber 34 underneath. The vacuum chamber 34 can be raised of lowered by turning four thumb screws 40 attached to the base 41 of the vacuum chamber 34 and inserted into brackets 42 in two lateral rails 43 (one shown) screwed to the underside 44 of the peripheral frame 45.

The tensional filter screen 38 is maintained in a stretched position by folding the margins of said screen 38 over and under the metal frame 37 and placing such fold in sandwiched relation between the peripheral frame 45 below, and the inner frame 46 above. This assembly is tightened by means of 10 screws 47. The peripheral frame 45 rests on a rabbet cut 48 around the rectangular opening 31 of the table platform 32. Similarly, a rabbet cut 49 is made around the inner edges of the peripheral frame 45 to receive the tensional filter 33 and the inner frame 46.

As shown in FIGS. 5A–5G the vacuum and humidification chamber 34 is a rectangular box 50 wherein humidification and suction take place. The vacuum chamber 34, contains, in horizontal position, four planar filters with decreasing filtering capacities to regulate the upward flow of humidity in the vacuum chamber 34, and to have suction act uniformly under the tensional filter 33 and under the disposable filter 30. Said filters, from top to bottom are: the final filter 51, the beehive filter 52, the columnar filter 53, and the solitary filter 54. The final filter 51 is the top of the vacuum chamber 34. The final filter 51, the beehive filter 52, and columnar filter rest 53 on top of one another respectively, while the solitary filter 54 is placed approximately one-half of an inch above the bottom 55 of the vacuum chamber 34.

The opening 59 on the left side is fitted with a ring 60 that rises about one-quarter of an inch above the bottom 55 of the vacuum chamber 34 whereupon condensed water and residual glue and residual paper fibers are deposited. Said ring 60 prevents drainage of residual matter through the hose 57 to the humidifier 61, thereby avoiding damage to humidifier 61 as shown in FIG. 6.

Furthermore, in the connection of the humidifier hose 57 to the left opening 59, a valve 62 is placed to regulate the flow of humidity. The left hose 57 is then connected to the humidifier 61. The opening 58 on the right side, level with the bottom 55 of the vacuum chamber 34, allows the drainage by suction of the condensed water, residual glue and residual paper fibers through the right hose 56 connecting the right opening 58 of the vacuum chamber 34 and the vacuum water tank 63 as shown in FIG. 6. Additionally, excessive humidity and vapors are suctioned off through said right opening 58.

The vacuum machine 64 houses a 120 volt, 70 watt motor. Said motor is controlled by a speed adjusting knob 65, thereby allowing regulation of the suction power of the vacuum machine 64. The vacuum machine 64, of cylindrical form, also houses the removable vacuum water tank 63. The vacuum water tank 63 collects the condensed water and humidity suctioned from the bottom 55 and from the interior of the vacuum chamber. As stated before, the vacuum machine motor can be turned off and on by means of a pedal switch 66 allowing freedom of the hands, or by a manual on/off switch 67 in the control panel 68.

Whereas the present invention has been described in particular relation to the drawings attached hereto, it should be understood that other and further modifications of the invention, apart from those shown or suggested, may be made within the scope and spirit of this invention.

Therefore, in view of the foregoing I claim:

1. A method for manual restoration of a work on paper comprising the steps of:

providing a dry fiber dispenser, said dry fiber dispenser including (a) a main body having a handle disposed to one side of said main body, (b) a vibrating motor attached at an upper end thereof to said main body, (c) a false funnel attached to a lower end of said motor, (d) a filter attached to a top portion of said false funnel, (e) a vibrating helix freely disposed on a top portion of said filter, and (f) a secondary funnel attached to a lower portion of said main body below said false funnel;

separating fibers of a dry restoration material in said dry fiber dispenser by passing said dry restoration material through said vibrating helix;

filtering said separated fibers through the filter of said dry fiber dispenser;

placing the separated and filtered fibers in an area of the work to be restored by passing said fibers through the secondary funnel of said dry fiber dispenser;

compacting the fibers from the secondary funnel into the area of the work to be restored; and applying dry glue to the compacted fibers, affixing the the compacted fibers to the work while subjecting the work to vacuum suction and localized humidification.

* * * * *